US011619109B2

(12) United States Patent
Almajed et al.

(10) Patent No.: US 11,619,109 B2
(45) Date of Patent: Apr. 4, 2023

(54) METHODS OF SEALING POLISHED BORE RECEPTACLES BY LOCALIZED SEALANT INJECTION

(71) Applicant: Saudi Arabian Oil Company, Dhahran (SA)

(72) Inventors: Mohammed Sameer Almajed, Alhasa (SA); Ahmed Mohammed Alghuryafi, Dhahran (SA); Mohammed A Asiri, Dhahran (SA); Mohammed A Atwi, Udhailiyah (SA)

(73) Assignee: Saudi Arabian Oil Company, Dhahran (SA)

( * ) Notice: Subject to any disclaimer, the term of this patent is extended or adjusted under 35 U.S.C. 154(b) by 30 days.

(21) Appl. No.: 17/323,122

(22) Filed: May 18, 2021

(65) Prior Publication Data

US 2022/0372839 A1 Nov. 24, 2022

(51) Int. Cl.

| | |
|---|---|
| ***E21B 33/14*** | (2006.01) |
| ***E21B 33/124*** | (2006.01) |
| ***E21B 23/06*** | (2006.01) |
| ***E21B 43/119*** | (2006.01) |
| ***E21B 29/00*** | (2006.01) |

(Continued)

(52) U.S. Cl.

CPC ..... *E21B 33/14* (2013.01); *E21B 23/06* (2013.01); *E21B 29/00* (2013.01); *E21B 33/124* (2013.01); *E21B 43/00* (2013.01); *E21B 43/119* (2013.01); *E21B 47/117* (2020.05)

(58) Field of Classification Search

CPC ..... E21B 33/13; E21B 33/14; E21B 33/124; E21B 47/117; E21B 23/06; E21B 29/00; E21B 43/00; E21B 43/119

See application file for complete search history.

(56) References Cited

U.S. PATENT DOCUMENTS 5,327,969 A 7/1994 Sabins et al.
5,829,523 A 11/1998 North (Continued)

OTHER PUBLICATIONS

Rusch et al., "Annulus Communmications Eliminated using Pressure-Activated Sealant", Solution Mining Research Institute, Technical Conference Paper, Spring 2005 Conference, Apr. 17-20, 2005.

(Continued)

*Primary Examiner* — Taras P Bemko
(74) *Attorney, Agent, or Firm* — Dinsmore & Shohl LLP

(57) ABSTRACT

A method of sealing one or more leak paths includes positioning an isolation plug in a production tubing. The production tubing is disposed within a wellbore casing assembly, each extending into a subsurface. The wellbore casing assembly includes a production casing. A tubing/casing annulus is disposed between the production casing and the production tubing. The one or more leak paths are fluidly coupled to the production tubing and the tubing/casing annulus and the isolation plug is positioned at a depth location below the one or more leak paths. The method also includes perforating the production tubing at a depth location above the isolation plug to form one or more sealant injection holes fluidly coupling the production tubing and the tubing/casing annulus and directing a sealant into the production tubing such that the sealant enters the tubing/casing annulus through the one or more sealant injection holes.

17 Claims, 6 Drawing Sheets

(51) Int. Cl.
*E21B 43/00* (2006.01)
*E21B 47/117* (2012.01)

(56) References Cited

U.S. PATENT DOCUMENTS

| | | | | |
|---|---|---|---|---|
| 2015/0101812 | A1* | 4/2015 | Bansal | E21B 29/002 166/55 |
| 2018/0252053 | A1* | 9/2018 | Rico | E21B 43/10 |
| 2019/0301265 | A1* | 10/2019 | Wardley | E21B 33/13 |
| 2020/0056446 | A1* | 2/2020 | Al-Mousa | E21B 33/1293 |
| 2020/0165896 | A1* | 5/2020 | Skeels | E21B 43/1185 |
| 2021/0222512 | A1* | 7/2021 | Pearl, Jr. | E21B 33/138 |

OTHER PUBLICATIONS

Xu et al., "Systematic Experimental Investigation on In-Situ Self-Adaptave Sealing Property of Composite Pressure-Activated Sealant for Curing Minor Tubular Leaks", Energies, vol. 13, 5597, 14 pgs., 2020.

* cited by examiner

METHODS OF SEALING POLISHED BORE RECEPTACLES BY LOCALIZED SEALANT INJECTION

BACKGROUND

Field

The present disclosure relates to a method of sealing leaks that form in a wellbore, and more specifically, leaks in a polished bore receptacle that is coupled to a production tubing disposed in a wellbore.

Technical Background

Conventionally, leaks in a wellbore caused by a polished bore receptacle are repaired by mobilizing a workover rig to perform the remedial job. However, the conventional, workover rig process is complicated and expensive. First, the hydrocarbon producing zone has to be isolated to avoid any formation damage or influx during workover operations. The workover rig will then move in and replace all the existing tubing. Following workover, the wellbore needs to be attended by a rigless site to mill the bridge plug by coiled tubing in order to regain the access to the hydrocarbon producing zone and resume production.

Accordingly, there is a desire for improved systems and methods for sealing leaks in a wellbore that do not require use of a workover rig.

SUMMARY

According to an embodiment of the present disclosure, a method of sealing one or more leak paths includes positioning an isolation plug in a production tubing. The production tubing is disposed within a wellbore casing assembly, each extending into a subsurface. The wellbore casing assembly includes a production casing. A tubing/casing annulus is disposed between the production casing and the production tubing. The one or more leak paths are fluidly coupled to the production tubing and the tubing/casing annulus and the isolation plug is positioned at a depth location below the one or more leak paths. The method also includes perforating the production tubing at a depth location above the isolation plug to form one or more sealant injection holes fluidly coupling the production tubing and the tubing/casing annulus and directing a sealant into the production tubing such that the sealant enters the tubing/casing annulus through the one or more sealant injection holes.

According to another embodiment of the present disclosure, a method of sealing a polished bore receptacle includes positioning an isolation plug in a production tubing. The production tubing is disposed within a wellbore casing assembly. The wellbore casing assembly extends into a subsurface and includes one or more wellbore casings surrounding the production tubing. At least one of the one or more wellbore casings is radially spaced apart from the production tubing, forming a tubing/casing annulus between at least one of the one or more wellbore casings and the production tubing. The polished bore receptacle is coupled to the production tubing. The polished bore receptacle includes a seal region. The isolation plug is positioned at a depth location below the seal region of the polished bore receptacle. The method further includes perforating the production tubing at a depth location between the isolation plug and the seal region of the polished bore receptacle to form one or more sealant injection holes fluidly coupling the production tubing and the tubing/casing annulus and directing a sealant into the production tubing such that the sealant enters the tubing/casing annulus through the one or more sealant injection holes.

Additional features and advantages of the processes and systems described herein will be set forth in the detailed description which follows, and in part will be readily apparent to those skilled in the art from that description or recognized by practicing the embodiments described herein, including the detailed description which follows, the claims, as well as the appended drawings.

It is to be understood that both the foregoing general description and the following detailed description describe various embodiments and are intended to provide an overview or framework for understanding the nature and character of the claimed subject matter. The accompanying drawings are included to provide a further understanding of the various embodiments, and are incorporated into and constitute a part of this specification. The drawings illustrate the various embodiments described herein, and together with the description serve to explain the principles and operations of the claimed subject matter.

BRIEF DESCRIPTION OF THE SEVERAL VIEWS OF THE DRAWINGS

The following detailed description of specific embodiments of the present disclosure can be best understood when read in conjunction with the following drawings, where like structure is indicated with like reference numerals and in which.

DETAILED DESCRIPTION

Figure 1:
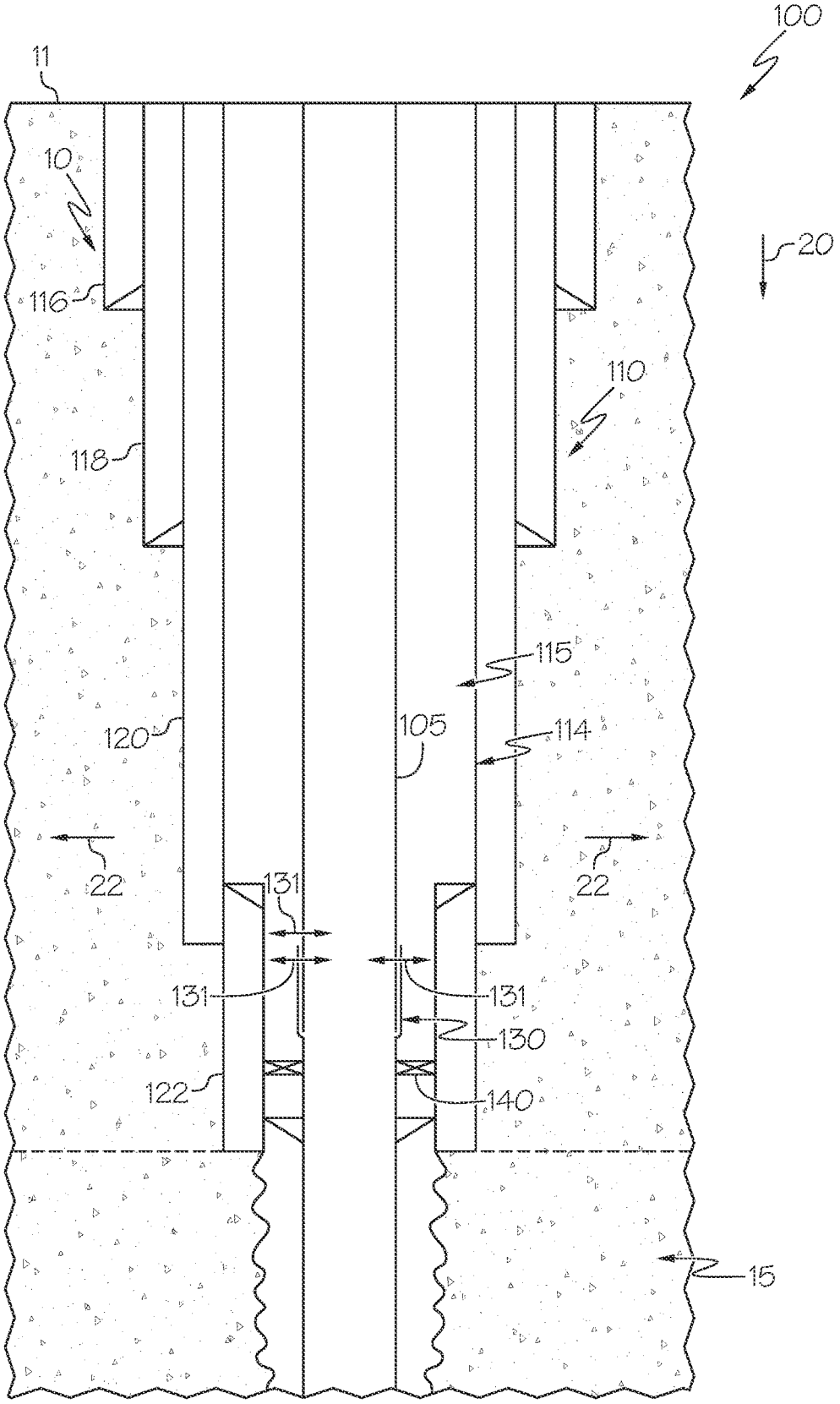
FIG. 1 schematically depicts a wellbore casing assembly and a production tubing extending into a wellbore, where a polished bore receptacle is coupled to the production tubing and includes one or more leak paths, according to one or more embodiments shown and described herein.

Reference will now be made to methods for repairing leaks that form in hydrocarbon production equipment that is positioned in a wellbore. During operation, one or leaks paths may form that create unwanted fluidly coupling between a production tubing and a tubing/casing annulus. For example, one or more leak paths may by located in a polished bore receptacle, and may be caused by a seal failure of the polished bore receptacle. The methods of repairing leaks include localized injection of a sealant from a production tubing into a tubing/casing annulus through sealant injection holes, which provide a fluid pathway between the production tubing and the tubing/casing annulus. In some embodiments, sealant is directed into the production tubing by bullheading the sealant directly into the production tubing. In other embodiments, sealant is directed into the production tubing using high pressure coiled tubing. Once the sealant is disposed in the tubing/casing annulus, the sealant solidifies, fluidly sealing leak paths and fluidly sealing the sealant injection holes. Embodiments of methods of repairing leaks in hydrocarbon production equipment by localized injection of a sealant will now be described and, whenever possible, the same reference numerals will be used throughout the drawings to refer to the same or like parts.

Referring now to FIG. 1, a wellbore 100 extending from a surface 11 into a subsurface 10 is schematically depicted. As used in the present disclosure, the term "wellbore" may refer to the drilled hole or borehole, including the openhole or uncased portion of the well. The wellbore 100 comprises a wellbore casing assembly 110 extending into the subsurface 10 and a production tubing 105 disposed within the wellbore casing assembly 110. As used herein, the term "production tubing" refers to a wellbore tubular used to produce reservoir fluids, such as hydrocarbons, which may be located in a hydrocarbon producing zone 15 of the subsurface 10. Production tubing is assembled with other completion components, including the wellbore casing assembly 110, to make up the production string. The production tubing selected for any completion should be compatible with the wellbore geometry, reservoir production characteristics and the reservoir fluids.

The wellbore casing assembly 110 comprises one or more wellbore casings 114 surrounding the production tubing 105. For example, in the example illustration of FIG. 1 (and FIGS. 2-6), the one or more wellbore casings 114 of the wellbore casing assembly 110 comprise a conductor casing 116, an intermediate casing 118, a production casing 120, and a production liner 122. In the embodiment shown in FIG. 1, the conductor casing 116 is coupled to and radially outward (i.e., in a radially outward direction 22) from the intermediate casing 118, which is coupled to and radially outward from the production casing 120. Each of the conductor casing 116, the intermediate casing 118, and the production casing 120 extend into from the surface 11 into the subsurface 10 in a depth direction 20. The production liner 122 is a liner casing that is radially inward from and coupled to the production casing 120 in a tieback fashion. As used herein, a "liner" or "liner casing" refers to a casing that does not extend back to the wellhead, hut is hung from another easing. That is, the production liner 122 is coupled to the production casing 120 within the subsurface 10 and does not reach the surface 11. The wellbore casing assembly 110 depicted in FIGS. 1-6 provides an illustrative example to contextualize the methods described herein, however, it should be understood that the methods described herein are applicable to a variety of wellbores and wellbore casing designs.

Referring still to FIG. 1, the production tubing 105 is disposed within the subsurface 10 radially inward from the wellbore casing assembly 110. In some embodiments, the production tubing 105 extends into the hydrocarbon producing zone 15 of the subsurface 10 and provides a fluid pathway for hydrocarbons to be drawn from the hydrocarbon producing zone 15 to the surface 11 (e.g., to a wellhead fluidly coupled to the production tubing 105). As shown in FIG. 1, the wellbore casings that are radially adjacent the production tubing 105, that is, the production casing 120 and the production liner 122, are radially spaced apart from the production tubing 105 in the radially outward direction 22, forming a tubing/casing annulus 115 therebetween. That is, the tubing/casing annulus 115 is positioned between at least one of the one or more wellbore casings 114 and the production tubing 105. Without intending to be limited by theory, the tubing/casing annulus 115 may perform a number of functions, including gas lift operations and well kill operations. Moreover, it should be understood that the wellbore 100 may comprise multiple annuluses. In embodiments comprising multiple annuluses, the tubing/casing annulus 115 may be referred to as an "A" annulus.

Referring still to FIG. 1, a production packer 140 extends radially between the production tubing 105 and the wellbore casing assembly 110, contacting the production tubing 105 and the wellbore casing assembly 110. In particular, in the embodiment of FIG. 1, the production packer 140 extends radially between the production tubing 105 and the production liner 122, contacting the production tubing 105 and the production liner 122. The production packer 140 is a sealing device that isolates and contains produced fluids and pressures within the wellbore casing assembly 110 and forms a base for the tubing/casing annulus 115. In operation, the production packer 140 prevents formation fluids going up the wellbore 100, which could otherwise damage the wellbore casing assembly 110. In some embodiments, the production packer 140 serves as an anchor point for the production liner 122.

Figure 2:
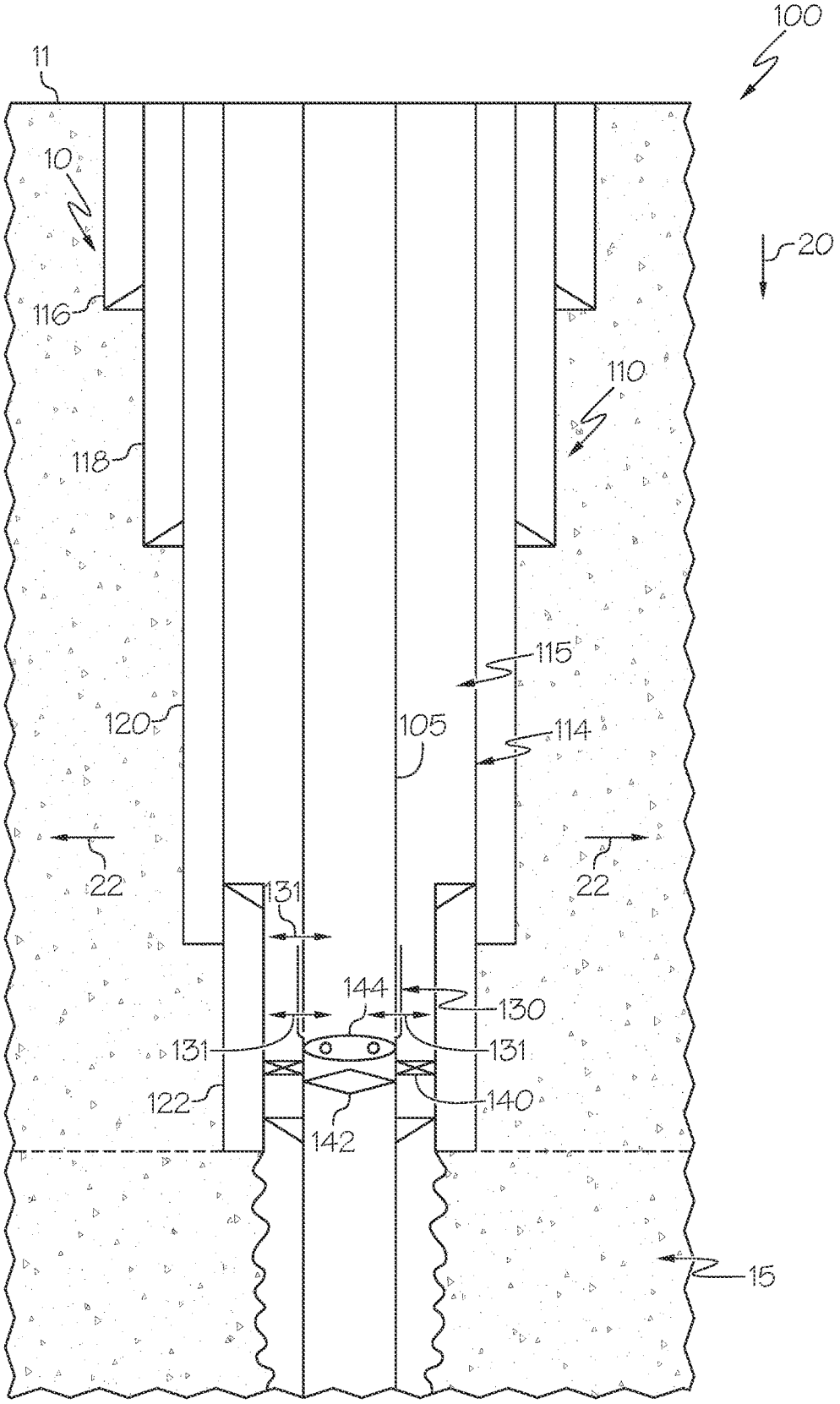
FIG. 2 schematically depicts the wellbore casing assembly and production tubing of FIG. 1, with an isolation plug disposed in the production tubing and one or more sealant injection holes formed in the production tubing above the isolation plug, according to one or more embodiments shown and described herein.
Figure 3A:
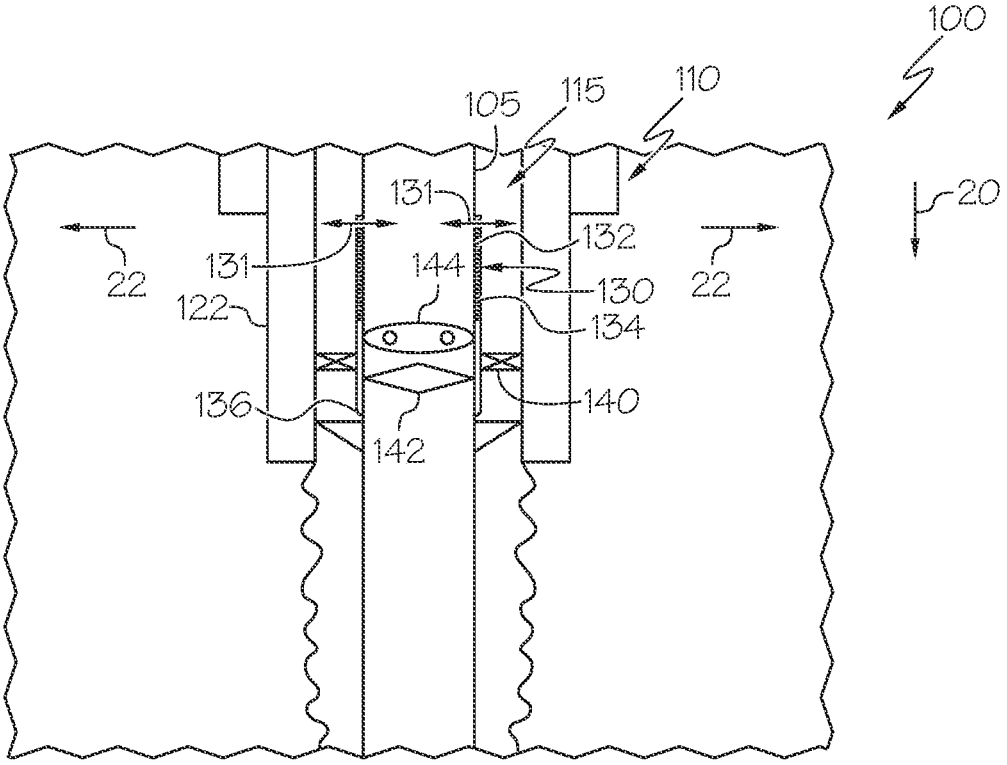
FIG. 3A schematically depicts an embodiment in which the sealant injection holes extend through both the production tubing and a coupling region of the polished bore receptacle, according to one or more embodiments shown and described herein.
Figure 3B:
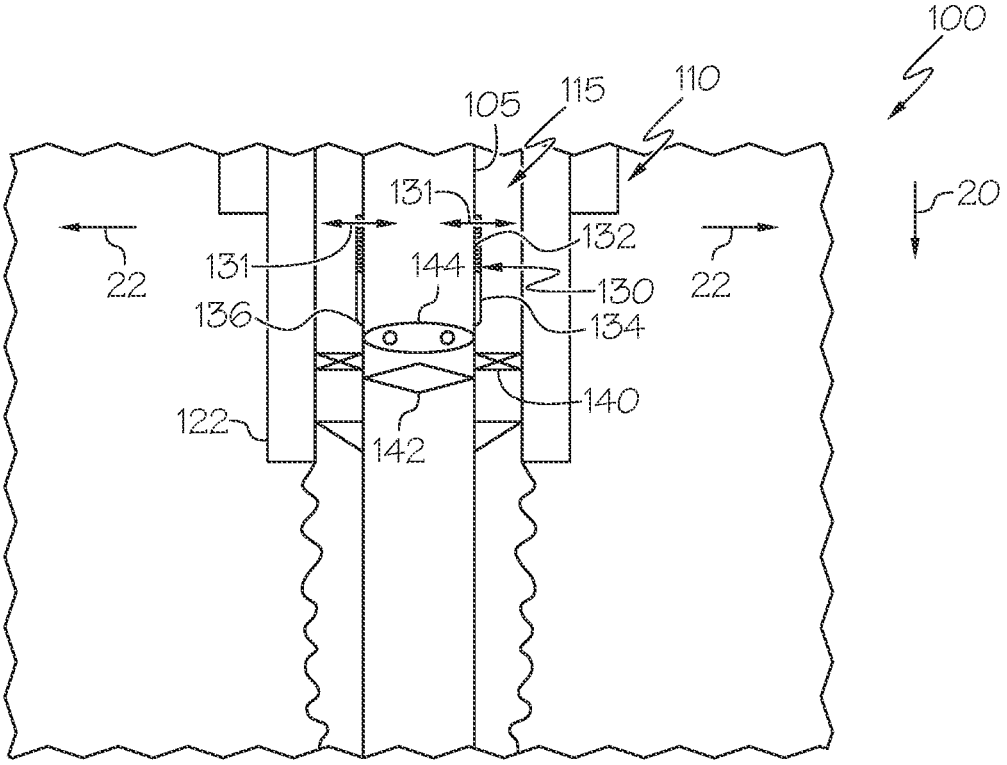
FIG. 3B schematically depicts an embodiment in which the sealant injection holes extend through the production tubing below the polished bore receptacle, according to one or more embodiments shown and described herein.

Referring now to FIG. 1-3B, a polished bore receptacle 130 is positioned in the tubing/casing annulus 115, coupled to the production tubing 105, for example, coupled to an outer surface of the production tubing 105. As depicted in FIGS. 3A and 3B, the polished bore receptacle 130 comprises a seal region 132 and a coupling region 134. The seal region 132 comprises one or more elastomer seals to form a fluid seal between the production tubing 105 and the tubing/casing annulus 115. In some embodiments, as shown in FIG. 3B, the coupling region 124 connects to the production packer 140. The polished bore receptacle 130 may provide a means of sealing the production tubing 105 to the top of the production packer 140 while maintaining maximum inner diameter in the production tubing 105. Without intending to be limited by theory, the polished bore receptacle 130 may operate as an expansion joint and/or a separation tool. As an expansion joint, the polished bore receptacle 130 provides stroke length for tubing movement during well treatment and production. The polished bore receptacle 130 may comprise a length of 32 feet or less and is used to land the production tubing 130 with a seal assembly. Indeed, the polished bore receptacle 130 isolates the interior of the production tubing 130 and the remainder of the wellbore 100 from the tubing/casing annulus 115 while along for movement of the production tubing 130 during well treatment and production. As a separation tool, the polished bore receptacle 130 allows removal of the production tubing 105, while leaving the polished bore receptacle 130 set into the production packer 140, such that the production tubing 105 may more easily be placed back into the wellbore 100.

Referring now to FIGS. 2-6, during hydrocarbon production, one or more leak paths 131 may develop that fluidly coupled the production tubing 130 and the tubing/casing annulus 115. These leak paths 131 are undesirable fluid pathways and may cause tubing failure (i.e., failure of the production tubing 105) and unwanted fluid communication between the production tubing 105 and the tubing/casing annulus 115. As depicted in FIG. 2, the one or more leak paths 131 may be located in the polished bore receptacle 130, the production tubing 130, or both. For example, leak paths 131 may be caused by pinholes in the production tubing 130. Moreover, in some embodiments, leak paths 131 may also be located in the production packer 140. Conventionally, such leaks are repaired by mobilizing a workover rig to perform the remedial job. However, the conventional, workover rig process is complicated and expensive. The hydrocarbon producing zone 15 of the subsurface 10 has to be isolated to avoid any formation damage or influx during workover operations. The workover rig will then move in and replace all the existing tubing. Following workover, the well needs to be attended by a rigless site to mill the bridge plug using coiled tubing to regain the access to the hydrocarbon producing zone 15 and resume production. The embodiments described herein provide an improved method of sealing leak paths 131 fluidly coupled to the production tubing 130 and the tubing/casing annulus 115 by localized injection of a sealant 150 into the tubing/casing annulus 115. The methods described herein will seal the leak paths 131 with or without the presence of pressure differential across the leak paths 131, in contrast to pressure active sealant techniques.

Referring now to FIG. 2-3B, the method of sealing the polished bore receptacle 130 first comprises positioning an isolation plug 142 in the production tubing 105. The isolation plug 142 is positioned at a depth location below the one or more leak paths 131. That is, the isolation plug 142 is disposed below the one or more leak paths 131 in the depth direction 20. In embodiments in which the leak paths 131 are positioned in the polished bore receptacle 130, it may be desirable to minimize the depth offset between the polished bore receptacle 130 and the isolation plug 142. Indeed, leak paths 131 often occur in the seal region 132 of the polished bore receptacle 130, however, it should be understood that the methods described herein may seal leak paths 131 that form in any part of the polished bore receptacle 130, such as the coupling region 134. In some embodiments, prior to positioning the isolation plug 142 in the production tubing 105, a presence of one of more leak paths in the seal region 132 of the polished bore receptacle 130 may be detected. This detection allows an operator to determine whether to undertake the repair procedure. The presence of the one or more leak paths in the seal region 132 of the polished bore receptacle 130 may be detected using a variety of detection devices and techniques, such as MIT logs, noise logs, marker pills, or combinations thereof.

Next, the method comprises perforating the production tubing 105 at a depth location between the isolation plug 142 and the one or more leak paths 131 to form one or more sealant injection holes 144 fluidly coupling the production tubing 105 and the tubing/casing annulus 115. For example, the sealant injection holes 144 may be formed between the isolation plug 142 and the seal region 132 of the polished bore receptacle 130. Perforating the production tubing 105 may be performed by a tubing puncher/perforator or other perforation device, that may be directed into the production tubing 105 using a wireline. In some embodiments, after perforating the production tubing 105 to form the one or more sealant injection holes 144, annulus fluid present in the tubing/casing annulus 115 (i.e., used annulus fluid) may be removed and thereafter replaced by replacement annulus fluid. Without intending to be limited by theory, when one or more leak paths 131 are present, gas may migrate through the leak paths 131 into the tubing/casing annulus 115, displacing and/or contaminating the proper annulus fluid. Thus, this used annulus fluid, which may be a mixture of annulus fluid and additional unwanted components, such as gas, may be flushed prior to sealing the one or more leak paths 131.

As depicted in FIGS. 3A and 3B, the production packer 140 is positioned in the tubing/casing annulus 115 at a depth location below the seal region 132 of the polished bore receptacle 130 and the one or more sealant injection holes 144. Furthermore, the depth location of the production packer 140 is between the isolation plug 142 and the one or more sealant injection holes 144. In some embodiments, as shown in FIG. 3A, the production packer 140 is coupled to the coupling region 134 of the polished bore receptacle 130 and the one or more sealant injection holes 144 extend through the production tubing 105 and the coupling region 134 of the polished bore receptacle 130. In other embodiments, as shown in FIG. 3B, the production packer 140 is positioned, along the depth direction 20, between the coupling region 134 of the polished bore receptacle 130 and the one or more sealant injection holes 144.

Figure 4:
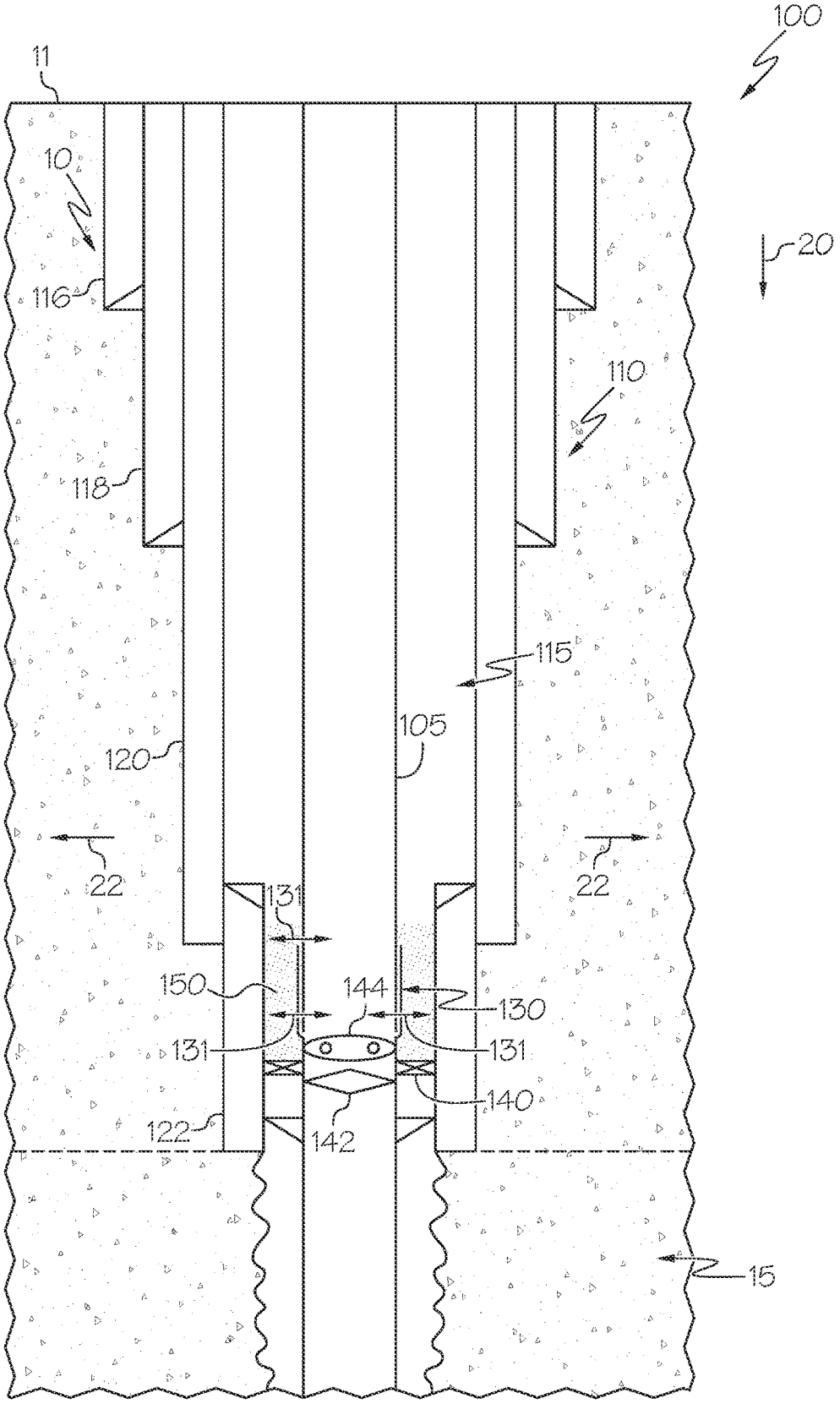
FIG. 4 schematically depicts the wellbore casing assembly and production tubing of FIGS. 1 and 2, in which sealant is disposed in a tubing/casing annulus radially adjacent both the one or more leak paths and the one or more sealant injection holes, according to one or more embodiments shown and described herein.
Figure 5:
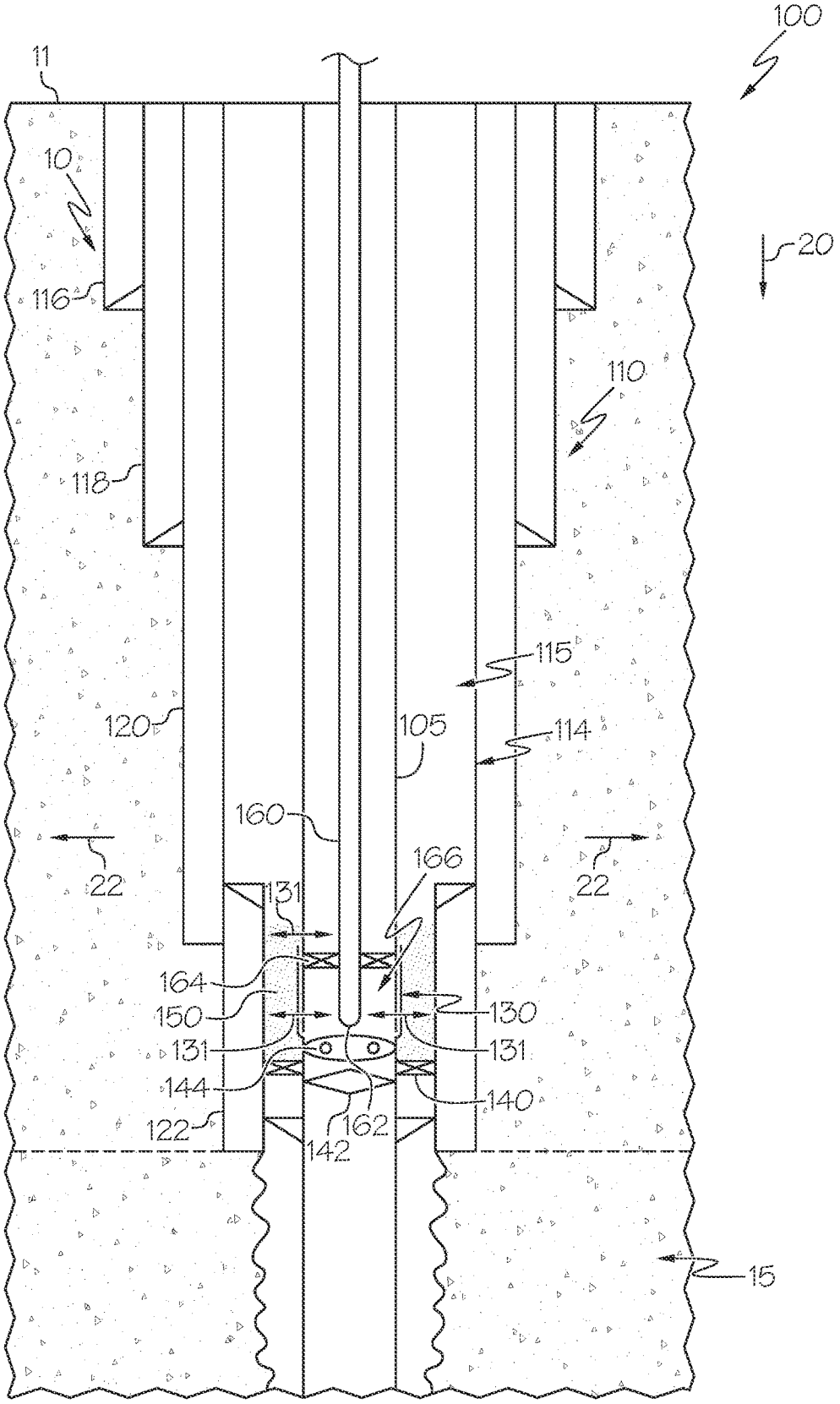
FIG. 5 schematically depicts the wellbore casing assembly and production tubing of FIGS. 1 and 2, with coiled tubing positioned in the production tubing and in which sealant is disposed in a tubing/casing annulus radially adjacent both the one or more leak paths and the one or more sealant injection holes, according to one or more embodiments shown and described herein.

Referring now to FIGS. 4 and 5, the method of sealing the leak paths 131 next comprises directing a sealant 150 into the production tubing 105 such that the sealant 150 enters the tubing/casing annulus 115 through the one or more sealant injection holes 144 and fills a portion of the tubing/casing annulus 115 radially adjacent the one or more leak paths 131. For example, the sealant 150 may fill a portion of the tubing/casing annulus 115 radially adjacent the seal region 132 of the polished bore receptacle 130. In some embodiments, as shown in FIG. 4, directing the sealant 150 into the production tubing 105 comprises pumping the sealant 150 into the production tubing 105 from the surface 11 of the subsurface 10. This is often referred to as "bullheading." In operation, the sealant 150 may be pumped into the production tubing 105 at a pumping rate of from 0.5 barrels per minute (bpm) to 5 bpm, such as from 1 bpm to 4 bpm, from 1 to 3 bmp, or any other range having any two of these values as endpoints. In other embodiments, as shown in FIG. 5, a coiled tubing 160 may be used to direct sealant into the production tubing 105, as described in more detail below.

Figure 6:
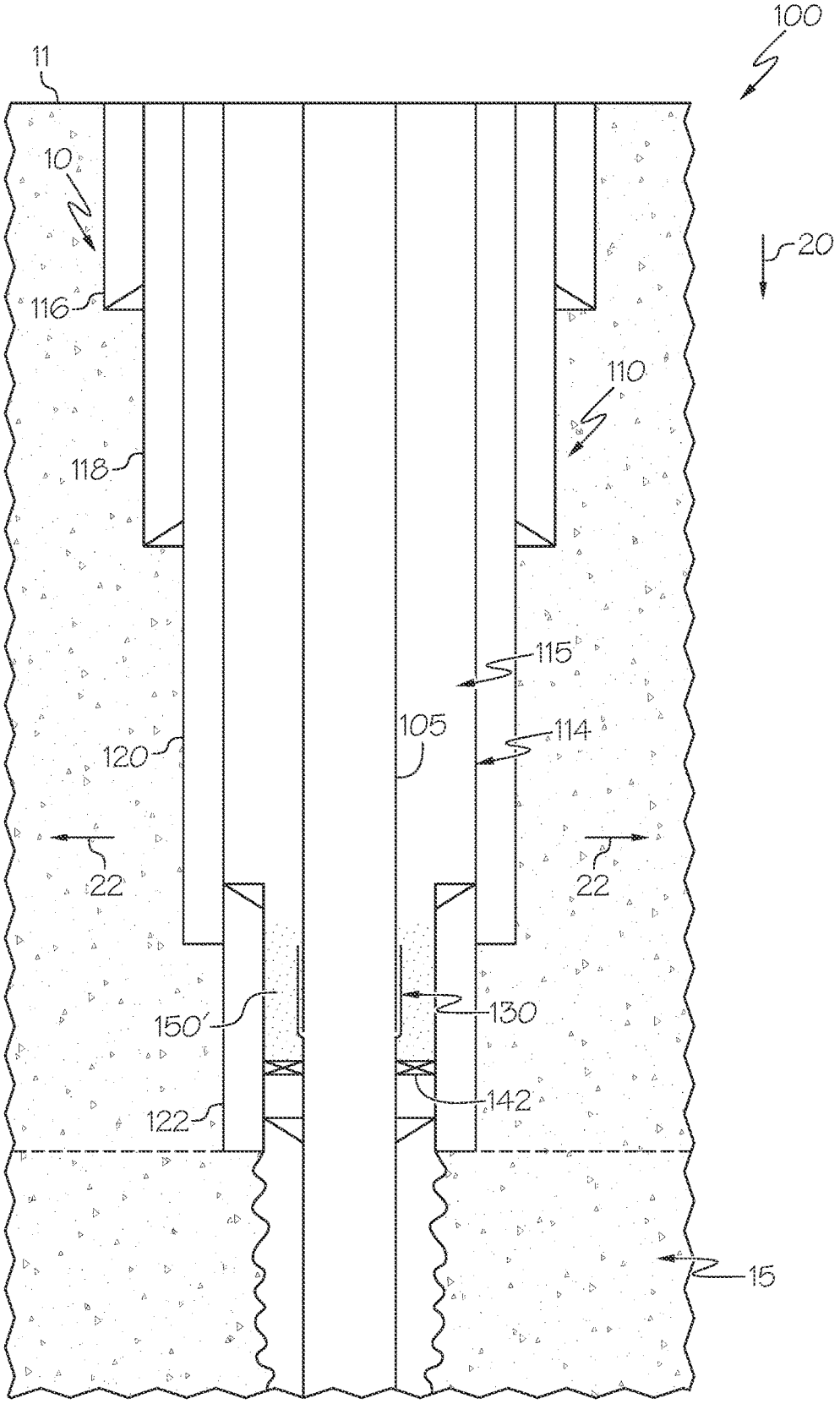
FIG. 6 schematically depicts the wellbore casing assembly and production tubing of FIGS. 1 and 2, in which sealant is solidified in a tubing/casing annulus radially adjacent both the one or more leak paths and the one or more sealant injection holes, according to one or more embodiments shown and described herein.

As shown in FIGS. 4 and 5, in some embodiments, the portion of the tubing/casing annulus 115 filled by the sealant 150 is also radially adjacent the one or more sealant injection holes 144. Indeed, as shown by FIGS. 4 and 5, the sealant 150 may fill a portion of the tubing/casing annulus 115 from the production packer 140 to a depth location above the polished bore receptacle 130. In some embodiments, volumetric calculations may be performed to determine the positioning of the sealant 150 in the tubing/casing annulus 115. That is, a computing device may use the pumping rate and information regarding the volume of the tubing/casing annulus 115 to determine when the sealant 150 has filled a portion of the tubing/casing annulus 115 that radially adjacent to both the one or more leak paths 131 and the one or more sealant injection holes 144. Moreover, in embodiments in which the locations of the leak paths 131 in the polished bore receptacle 130 have not been determined, volumetric calculations may be determined when the sealant 150 has filled a portion of the tubing/casing annulus 115 that radially adjacent the entire polished bore receptacle 130 and the one or more sealant injection holes 144, to ensure that any leak paths 131 in the polished bore receptacle are filled with sealant 150. The sealant 150 is configured to solidify after a solidification period forming solidified sealant 150' (FIG. 6). Once solidified, the solidified sealant 150' forms a seal in the tubing/casing annulus 115, preventing fluid communication between the production tubing 105 and the tubing/casing annulus 115 at the polished bore receptacle 130. As depicted in FIG. 6, after the solidification period, the solidified sealant 150' fluidly seals the one or more leak paths 131 and the newly formed fluid pathways of the one or more sealant injection holes 144, providing a permanent fluid barrier in the one or leak paths 131.

Referring now to FIGS. 4-6, after the solidification period, the isolation plug 142 may be altered such that fluid may freely flow through the production tubing 105. In some embodiments, this comprises milling the isolation plug 142. In other embodiments, the isolation plug may be retrieved. Once the isolation plug 142 is altered such that fluid may freely flow, production may continue and hydrocarbon may be drawn from the hydrocarbon producing zone 15 of the subsurface 10 through the production tubing 105. Without intending to be limited by theory, hydrocarbons from the hydrocarbon producing zone 15 of the subsurface 10 pass through fractures in the subsurface 10 to reach the wellbore 100 for extraction to the surface 11 through the production tubing 105. The formation pressure in the hydrocarbon producing zone 15 of the subsurface 10 may be greater than the downhole pressure inside the wellbore 100 and this differential pressure may drive hydrocarbons through fractures in the subsurface 10 toward the wellbore 100 and up to surface 11 through the production tubing 105.

Referring still to FIGS. 4 and 5, the sealant 150 may comprise a resin sealant mixture or a cement sealant mixture. The cement sealant mixture comprises at least a cement slurry. As used herein, "cement slurry" refers to a composition comprising cement particles that is mixed with at least water to form cement. The cement slurry may contain calcined alumina ($Al_2O_3$), silica ($SiO_2$), calcium oxide (CaO, also known as lime), iron oxide (FeO), magnesium oxide (MgO), clay, sand, gravel, and mixtures of these. The cement slurry may further comprise one or more additives. The one or more additives may be any additives known to be suitable for cement slurries. As non-limiting examples, suitable additives may include accelerators, retarders, extenders, suspending agents, weighting agents, gas tight additives (which may prevent gas migration), fluid loss control agents, lost circulation control agents, surfactants, antifoaming agents, expansion agents, and combinations of these. In one example embodiment, the cement sealant mixture comprises at least, cement (i.e., cement particles and water), $SiO_2$, and an expansion agent, for example, from 60 wt % to 70 wt % of cement, from 30 wt % to 40 wt % of $SiO_2$, and from 0.5 wt % to 1.5 wt % of the expansion agent.

Referring now to FIG. 5, the sealant 150 may be directed into the production tubing 105 using the coiled tubing 160, which is temporarily inserted into the production tubing 105. As used herein, "coiled tubing" refers to a long, continuous length of pipe wound on a spool. The pipe is straightened prior to pushing into the production tubing 105 and rewound to coil the pipe back onto the transport and storage spool. In particular, directing the sealant 150 into the production tubing 105 may comprise inserting the coiled tubing 160 into the production tubing 105 such that a tubing end 162 of the coiled tubing 160 is positioned at a depth location above the one or more sealant injection holes 144. For example, the tubing end 162 may be positioned at a depth location above the one or more sealant injection holes 144 and adjacent at least a portion of the polished bore receptacle 130. In some embodiments, the coiled tubing 160 comprises a high pressure coiled tubing.

In embodiments using the coiled tubing 160, a coiled tubing packer 164 may be positioned in the production tubing 105 in contact with the coiled tubing 160 and the production tubing 105 at a depth location above the tubing end 162, thereby forming a sub-chamber 166 within the production tubing 105 between the coiled tubing packer 164 and the isolation plug 142. Next, sealant 150 may be directed from the tubing end 162 of the coiled tubing 160 into the sub-chamber 166 such that the sealant 150 enters the tubing/casing annulus 115 through the one or more sealant injection holes 144 and fills a portion of the tubing/casing annulus 115 and fluid seals the one or more leak paths 131, as well as the one or more sealant injection holes 144 after the solidification period. After the solidification period, the coiled tubing 160 may be removed from the production tubing 105 and the isolation plug 142 may be altered (e.g., milled or removed) such that fluid may freely flow through the production tubing 105. At this point, production may continue and hydrocarbon may be drawn from the subsurface 10 through the production tubing 105.

In view of the foregoing description, it should be understood that the methods described herein for repairing leak paths include localized injection of a sealant from a production tubing into a tubing/casing annulus through sealant injection holes, which provide a fluid pathway between the production tubing and the tubing/casing annulus. After a solidification period, the sealant fluidly seals both the leak paths and the sealant injection holes. The methods may include bullheading the sealant directly into the production tubing or directing sealant into the production tubing using high pressure coiled tubing.

For the purposes of describing and defining the present inventive technology, it is noted that reference herein to a variable being a "function" of a parameter or another variable is not intended to denote that the variable is exclusively a function of the listed parameter or variable. Rather, reference herein to a variable that is a "function" of a listed parameter is intended to be open ended such that the variable may be a function of a single parameter or a plurality of parameters.

It is also noted that recitations herein of "at least one" component, element, etc., should not be used to create an inference that the alternative use of the articles "a" or "an" should be limited to a single component, element, etc.

It is noted that recitations herein of a component of the present disclosure being "configured" in a particular way, to embody a particular property, or function in a particular manner, are structural recitations, as opposed to recitations of intended use. More specifically, the references herein to the manner in which a component is "configured" denotes an existing physical condition of the component and, as such, is to be taken as a definite recitation of the structural characteristics of the component.

For the purposes of describing and defining the present inventive technology it is noted that the terms "substantially" and "about" are utilized herein to represent the inherent degree of uncertainty that may be attributed to any quantitative comparison, value, measurement, or other representation. The terms "substantially" and "about" are also utilized herein to represent the degree by which a quantitative representation may vary from a stated reference without resulting in a change in the basic function of the subject matter at issue.

Having described the subject matter of the present disclosure in detail and by reference to specific embodiments thereof, it is noted that the various details disclosed herein should not be taken to imply that these details relate to elements that are essential components of the various embodiments described herein, even in cases where a particular element is illustrated in each of the drawings that accompany the present description. Further, it will be apparent that modifications and variations are possible without departing from the scope of the present disclosure, including, but not limited to, embodiments defined in the appended claims. More specifically, although some aspects of the present disclosure are identified herein as preferred or particularly advantageous, it is contemplated that the present disclosure is not necessarily limited to these aspects.

It is noted that one or more of the following claims utilize the term "wherein" as a transitional phrase. For the purposes of defining the present inventive technology, it is noted that this term is introduced in the claims as an open-ended transitional phrase that is used to introduce a recitation of a series of characteristics of the structure and should be interpreted in like manner as the more commonly used open-ended preamble term "comprising.

What is claimed is:

1. A method of sealing one or more leak paths, the method comprising:

positioning an isolation plug in a production tubing, wherein:

the production tubing is disposed within a wellbore casing assembly, each extending into a subsurface;

the wellbore casing assembly comprises a production casing;

a tubing/casing annulus is disposed between the production casing and the production tubing;

the one or more leak paths are fluidly coupled to the production tubing and the tubing/casing annulus; and the isolation plug is positioned at a depth location below the one or more leak paths;

perforating the production tubing at a depth location above the isolation plug to form one or more sealant injection holes fluidly coupling the production tubing and the tubing/casing annulus;

directing a sealant into the production tubing such that the sealant enters the tubing/casing annulus through the one or more sealant injection holes;

milling the isolation plug after the sealant is disposed in the tubing/casing annulus for a solidification period; and drawing a hydrocarbon from the subsurface through the production tubing subsequent to milling the isolation plug.

2. The method of claim 1, wherein a polished bore receptacle is coupled to the production tubing and comprises at least one of the one or more leak paths.

3. The method of claim 1, wherein the one or more sealant injection holes are perforated at a depth location below the one or more leak paths.

4. The method of claim 1, wherein the portion of the tubing/casing annulus filled by the sealant is radially adjacent the one or more sealant injection holes and the one or more leak paths, fluidly sealing the one or more sealant injection holes and the one or more leak paths.

5. The method of claim 1, wherein a production packer is positioned in the tubing/casing annulus at a depth location below the one or more leak paths and the one or more sealant injection holes.

6. The method of claim 1, wherein the sealant comprises a resin sealant mixture or a cement sealant mixture.

7. The method of claim 1, wherein directing the sealant into the production tubing comprises:

inserting a coiled tubing into the production tubing such that an tubing end of the coiled tubing is positioned at a depth location above the one or more sealant injection holes;

positioning a coiled tubing packer in the production tubing in contact with the coiled tubing and the production tubing at a depth location above the tubing end, thereby forming a sub-chamber within the production tubing between the coiled tubing packer and the isolation plug; and directing the sealant from the tubing end of the coiled tubing into the sub-chamber such that the sealant enters the tubing/casing annulus through the one or more sealant injection holes and fills a portion of the tubing/casing annulus radially adjacent the one or more leak paths.

8. A method of sealing one or more leak paths, the method comprising:

positioning an isolation plug in a production tubing, wherein:

the production tubing is disposed within a wellbore casing assembly, each extending into a subsurface;

the wellbore casing assembly comprises a production casing;

a tubing/casing annulus is disposed between the production casing and the production tubing;

the one or more leak paths are fluidly coupled to the production tubing and the tubing/casing annulus; and the isolation plug is positioned at a depth location below the one or more leak paths;

perforating the production tubing at a depth location above the isolation plug to form one or more sealant injection holes fluidly coupling the production tubing and the tubing/casing annulus;

directing a sealant into the production tubing such that the sealant enters the tubing/casing annulus through the one or more sealant injection holes; and removing used annulus fluid from the tubing/casing annulus subsequent to perforating the production tubing and replacing the used annulus fluid in the tubing/casing annulus with replacement annulus fluid prior to directing the sealant into the production tubing.

9. A method of sealing one or more leak paths, the method comprising:

positioning an isolation plug in a production tubing, wherein:

the production tubing is disposed within a wellbore casing assembly, each extending into a subsurface;

the wellbore casing assembly comprises a production casing;

a tubing/casing annulus is disposed between the production casing and the production tubing;

the one or more leak paths are fluidly coupled to the production tubing and the tubing/casing annulus; and the isolation plug is positioned at a depth location below the one or more leak paths;

perforating the production tubing at a depth location above the isolation plug to form one or more sealant injection holes fluidly coupling the production tubing and the tubing/casing annulus;

directing a sealant into the production tubing such that the sealant enters the tubing/casing annulus through the one or more sealant injection holes; and prior to positioning the isolation plug in the production tubing, detecting a presence of the one or more leak paths.

10. A method of sealing a polished bore receptacle, the method comprising:

positioning an isolation plug in a production tubing, wherein:

the production tubing is disposed within a wellbore casing assembly;

the wellbore casing assembly extends into a subsurface and comprises one or more wellbore casings surrounding the production tubing;

at least one of the one or more wellbore casings is radially spaced apart from the production tubing, forming a tubing/casing annulus between at least one of the one or more wellbore casings and the production tubing;

the polished bore receptacle is coupled to the production tubing;

the polished bore receptacle comprises a seal region; and the isolation plug is positioned at a depth location below the seal region of the polished bore receptacle;

perforating the production tubing at a depth location between the isolation plug and the seal region of the polished bore receptacle to form one or more sealant injection holes fluidly coupling the production tubing and the tubing/casing annulus;

directing a sealant into the production tubing such that the sealant enters the tubing/casing annulus through the one or more sealant injection holes; and directing the sealant into the production tubing comprises:

inserting a coiled tubing into the production tubing such that an tubing end of the coiled tubing is positioned at a depth location above the one or more sealant injection holes;

positioning a coiled tubing packer in the production tubing in contact with the coiled tubing and the production tubing at a depth location above the tubing end, thereby forming a sub-chamber within the production tubing between the coiled tubing packer and the isolation plug; and directing the sealant from the tubing end of the coiled tubing into the sub-chamber such that the sealant enters the tubing/casing annulus through the one or more sealant injection holes and fills a portion of the tubing/casing annulus radially adjacent the seal region of the polished bore receptacle.

11. The method of claim 10, wherein the sealant fills a portion of the tubing/casing annulus radially adjacent the seal region of the polished bore receptacle and the one or more sealant injection holes, fluidly sealing the seal region of the polished bore receptacle and the one or more sealant injection holes.

12. The method of claim 10, wherein the seal region of the polished bore receptacle comprises one or more elastomer seals.

13. The method of claim 10, wherein a production packer is positioned in the tubing/casing annulus at a depth location below the seal region of the polished bore receptacle and the one or more sealant injection holes.

14. The method of claim 13, wherein the production packer is coupled to a coupling region of the polished bore receptacle.

15. The method of claim 10, wherein the sealant comprises a resin sealant mixture or a cement sealant mixture.

16. The method of claim 10, further comprising milling the isolation plug after the sealant is disposed in the portion of the tubing/casing annulus radially adjacent the seal region of the polished bore receptacle for a solidification period and thereafter drawing a hydrocarbon from the subsurface through the production tubing.

17. The method of claim 10, further comprising removing the coiled tubing and milling the isolation plug after the sealant is disposed in the portion of the tubing/casing annulus radially adjacent the seal region of the polished bore receptacle for a solidification period.

* * * * *